US006481257B1

(12) United States Patent
Chartier

(10) Patent No.: US 6,481,257 B1
(45) Date of Patent: Nov. 19, 2002

(54) AUTOMOBILE REPAIR CLAMP

(76) Inventor: Guy Chartier, 34 Scarcliff Gardens, West Hill, Ontario (CA), M1E 2A2

( * ) Notice: Subject to any disclaimer, the term of this patent is extended or adjusted under 35 U.S.C. 154(b) by 0 days.

(21) Appl. No.: 09/732,319

(22) Filed: Dec. 7, 2000

(51) Int. Cl.[7] ..... B21D 1/12

(52) U.S. Cl. ..... 72/308; 72/705

(58) Field of Search ..... 294/902; 72/308, 72/422, 705

(56) References Cited

U.S. PATENT DOCUMENTS 246,632 A * 9/1881 Palmer ..... 294/902
2,326,962 A * 8/1943 Meier ..... 294/902

FOREIGN PATENT DOCUMENTS

JP 6-24299 * 2/1994 ..... 72/705

* cited by examiner

*Primary Examiner*—Lowell A. Larson
(74) *Attorney, Agent, or Firm*—Ridout & Maybee LLP

(57) ABSTRACT

An automobile repair clamp for clamping onto an anchor point on a damaged structural component of an automobile. The clamp can be coupled to a pulling device for pulling the anchor point to straighten the structural component, and includes a pair of clamping jaws movable together into a clamping position and apart to respectively grip and release the anchor point. Also included is a locking mechanism coupled to the clamping jaws for selectively locking the jaws in the clamping position. The clamping jaws each include a rotatable gripper for gripping the anchor point and permitting adjustment of the angle of the clamping jaws in a first plane relative to the structural component to allow the clamp to be aligned with the direction of pull by the pulling device.

8 Claims, 15 Drawing Sheets

AUTOMOBILE REPAIR CLAMP

FIELD OF THE INVENTION

This invention relates to automobile repair accessories and, more particularly, to clamps for use in providing an anchor or pulling point when straightening a structural component of an automobile such as the frame or body thereof.

BACKGROUND OF THE INVENTION

When repairing a structural component of a damaged automobile, such as the frame or body thereof, or both in the case of unibody automobiles, it is common to use a power-pull system in which select portions of the automobile are anchored by attachment to respective chains extending to tie-down points on the ground. A clamp is attached to an anchor or pulling point on the structural component and coupled to a hydraulic pulley using a chain. The pulley applies a pulling force to the anchor point which serves to straighten the structural component.

Conventional automobile repair clamps used in the system have clamp bodies comprising a pair of unitary clamping jaws which may be cantilevered about a pivot joint to bring gripping portions of the clamping jaws together in gripping engagement with the anchor point on the structural component. Both the pivot joint and the gripping portions are frequently fixed in position relative to the clamp body as a whole. A fixed pivot joint may prevent the gripping portions of the clamping jaws from being mounted to the desired anchor point as the pivot joint may come in contact with nearby obstructions. Fixing gripping portions relative to the clamping jaws means that the clamps are often attachable to a structural component in only one of a few positions. Thus, it may not be possible to align the body of the clamp with the direction of pull while achieving the needed grip on the structural component. Improper alignment of the clamp body may cause the structural component to warp during pulling, thereby creating secondary damage.

Other disadvantages of prior art repair clamps are that they often can only be used to pull portions of a vehicle body in one dimension or plane. However, due to the nature and extent of the damage, it may be desirable to pull a vehicle portion in different dimensions. Furthermore, they tend to have gripping portions which are of a predetermined shape and size and therefore may not be suitable for gripping certain areas of the structural component.

Consequently, different shaped and sized clamps must be used depending on the configuration of the anchor point and its immediate surrounding environment. An autobody repairman must therefore have a large variety of clamps at his disposal which can prove expensive and space-consuming.

Accordingly, an object of the present invention is to provide an improved automobile repair clamp which overcome the above disadvantages.

SUMMARY OF THE INVENTION

This invention provides an automobile repair clamp for clamping onto an anchor point on a damaged structural component of an automobile. The clamp is adapted to be coupled to a pulling device for pulling the anchor point to straighten the structural component. The clamp includes a pair of clamping jaws movable together into a clamping position and apart to respectively grip and release the anchor point. Also included is a locking mechanism coupled to the clamping jaws for selectively locking the jaws in the clamping position. The clamping jaws each include a rotatable gripper for gripping the anchor point and permitting adjustment of the angle of the clamping jaws in a first plane relative to the structural component to allow the clamp to be aligned with the direction of pull by the pulling device.

The grippers may be removable and interchangeable with other grippers of different shapes and sizes, and selected to ensure that a proper grip is achieved on the anchor point. Also, the distance between the gripping surface of each gripper and the corresponding clamping jaw may be adjustable to accommodate anchor points of varying thicknesses.

Each clamping jaw may have opposite first and second end portions connected by a bridge with the grippers being disposed in the first end portions. The locking mechanism may include an adjustable pivot assembly including a pivot member secured to the bridges in one of a selected number of positions, and a biasing assembly disposed in the second end portions for biasing the second end portions apart to exert a force about the pivot member and to leverage the first end portions and grippers together into the clamping position.

The clamp may include a connector rotatably coupled to the clamping jaws for connecting the clamp to the pulling device and permitting the clamp to be oriented in one of a number of angular positions within the first plane relative to the structural component. Alternatively, or additionally, the clamp may include a bracket removably attached to one of the clamping jaws for pivotally retaining a connector useful in coupling the clamp to a pulling device for pulling the clamp in a second plane generally perpendicular to the first plane.

Clamps according to the present invention have several advantages. First, the rotatable grippers permit alignment of the clamp with the direction of pull to avoid or minimize secondary damage during the repair process. Second, because the grippers are interchangeable and come in different shapes, and sizes, and have different gripping surfaces, a repairman can select the proper grippers to suit the job. As compared to having to have a variety of different clamps on hand, this results in space savings and reduced costs. Third, clamps having adjustable pivot assemblies may be mounted over or past obstructions since the pivot members of the assemblies may be shifted to avoid contact with the obstructions. Fourth, the clamps can be used to pull an anchor point in two planes which increases dramatically the number of directions in which the automobile structural component may be pulled.

BRIEF DESCRIPTION OF THE DRAWINGS

Other features and advantages of the invention will become apparent, and the invention will be better understood, with reference to the following description of the preferred embodiments taken together with the drawings in which.

DETAILED DESCRIPTION OF THE PREFERRED EMBODIMENTS

Figure 1:
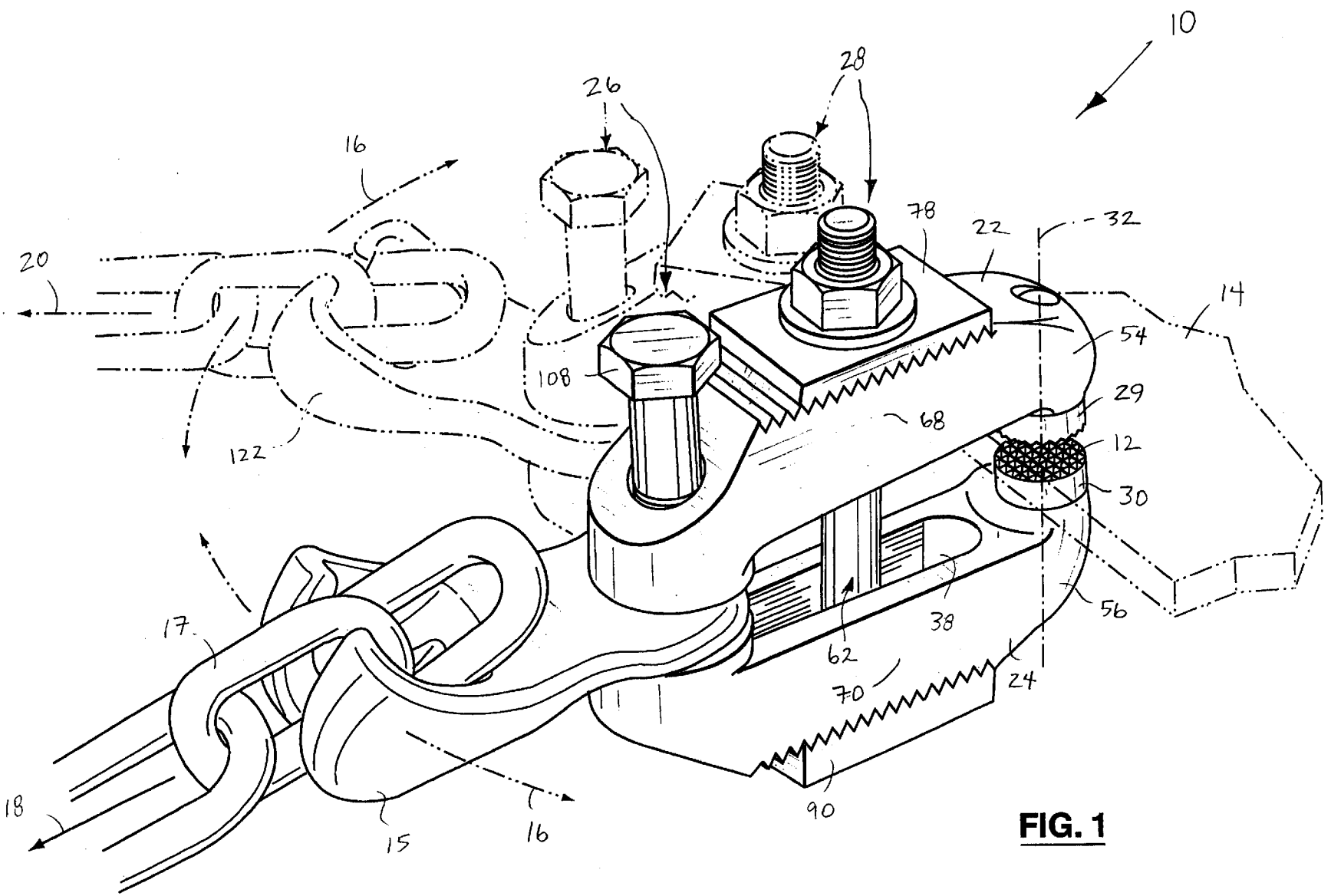
FIG. 1 is a perspective view of an automobile repair clamp according to a first preferred embodiment of the invention shown in a clamping position on an anchor point of structural component of an automobile, an alternative position being shown in chain-dotted outline.
Figure 2A:
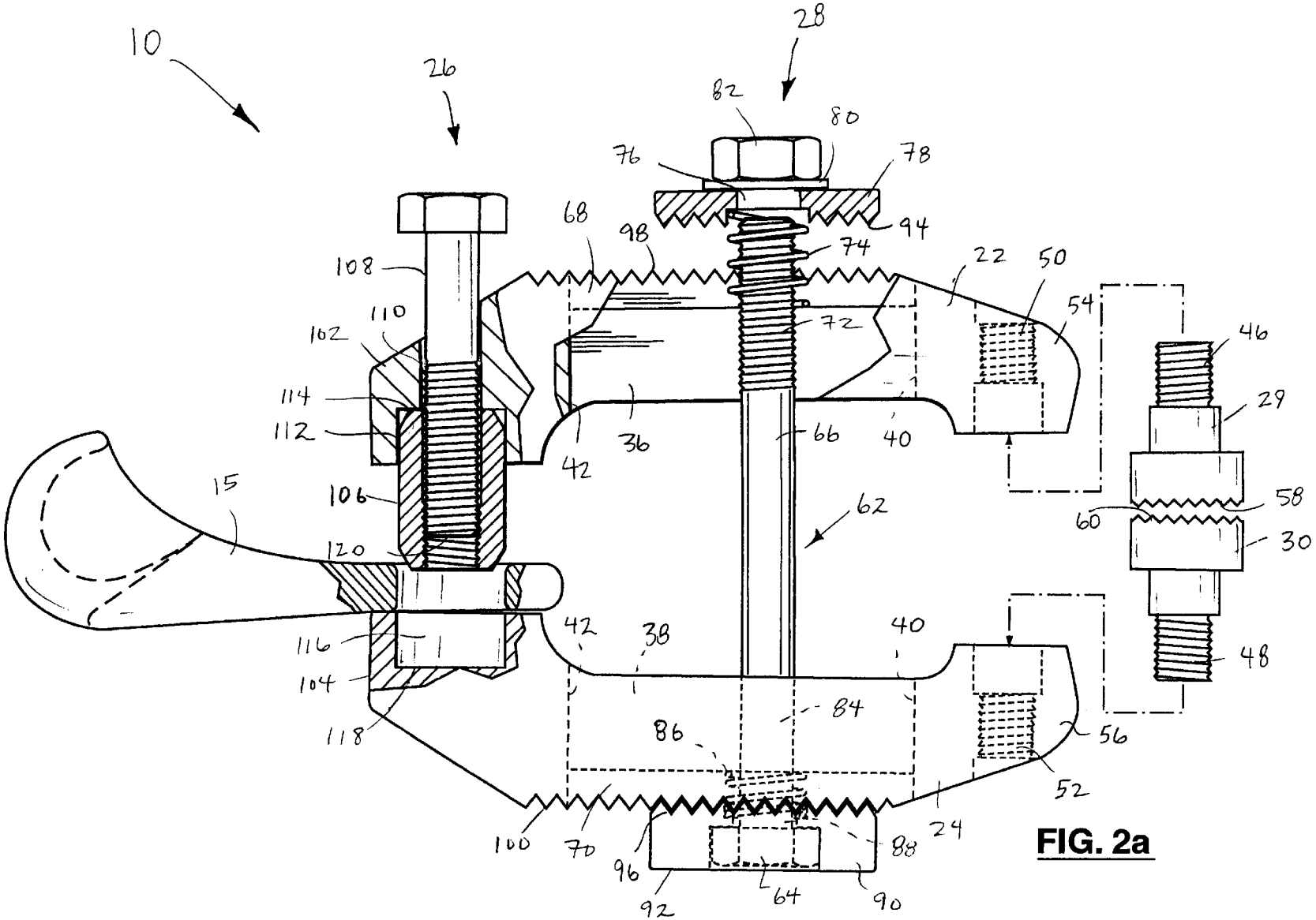
FIG. 2*a* is a side view of the clamp of FIG. 1 shown partially exploded and with portions broken away to reveal details of structure.
Figure 2B:
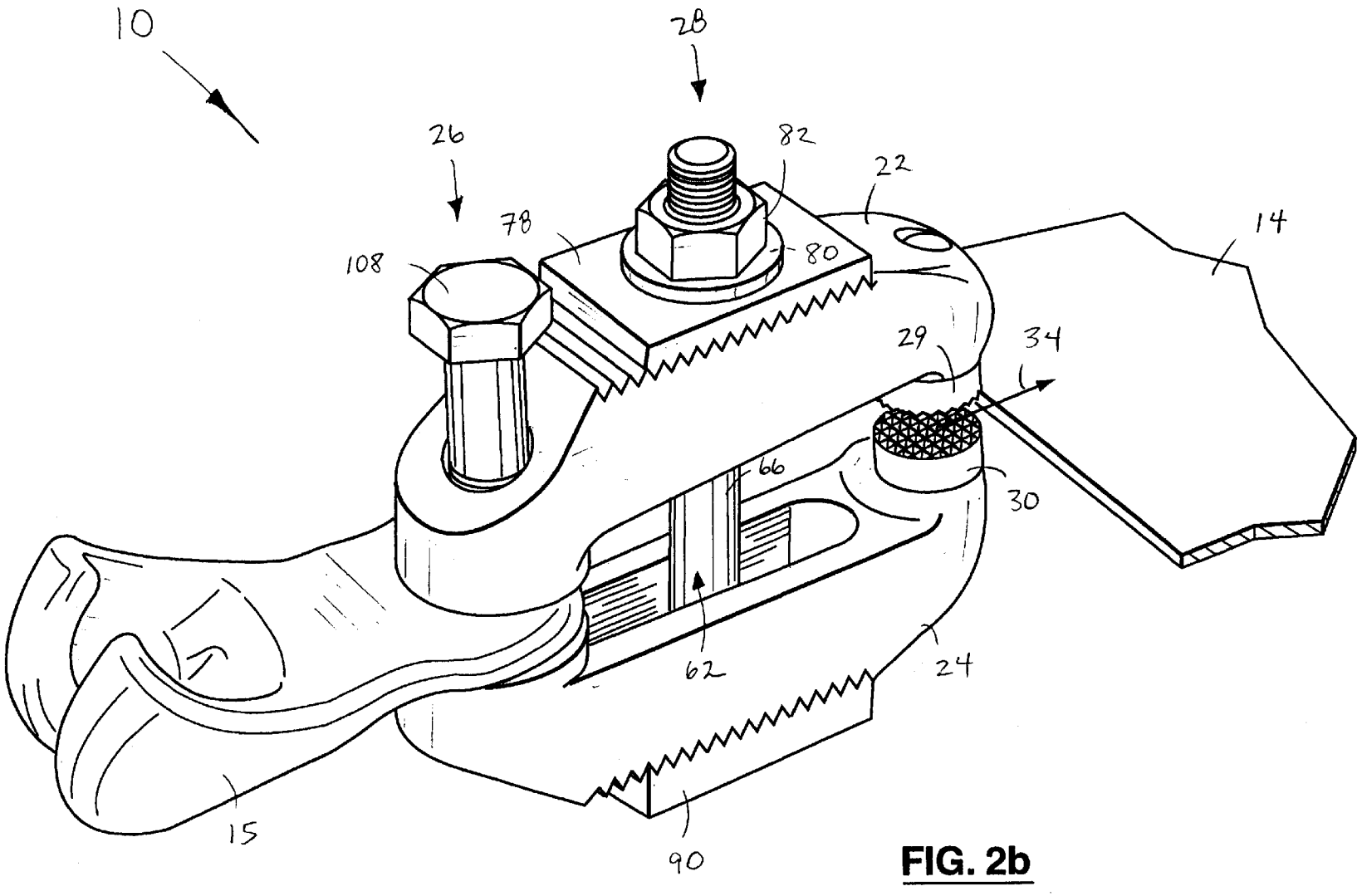
FIGS. 2*b–d* are additional perspective views of the clamp of FIG. 1 showing, in sequence, the clamp being mounted on an anchor point of an automobile structural component of an automobile, FIGS. 2*b* and *c* showing the clamp being positioned thereon, and FIG. *d* showing a locking mechanism of the clamp being operated to bring clamping jaws of the clamp together into the clamping position on the anchor point.
Figure 2C:
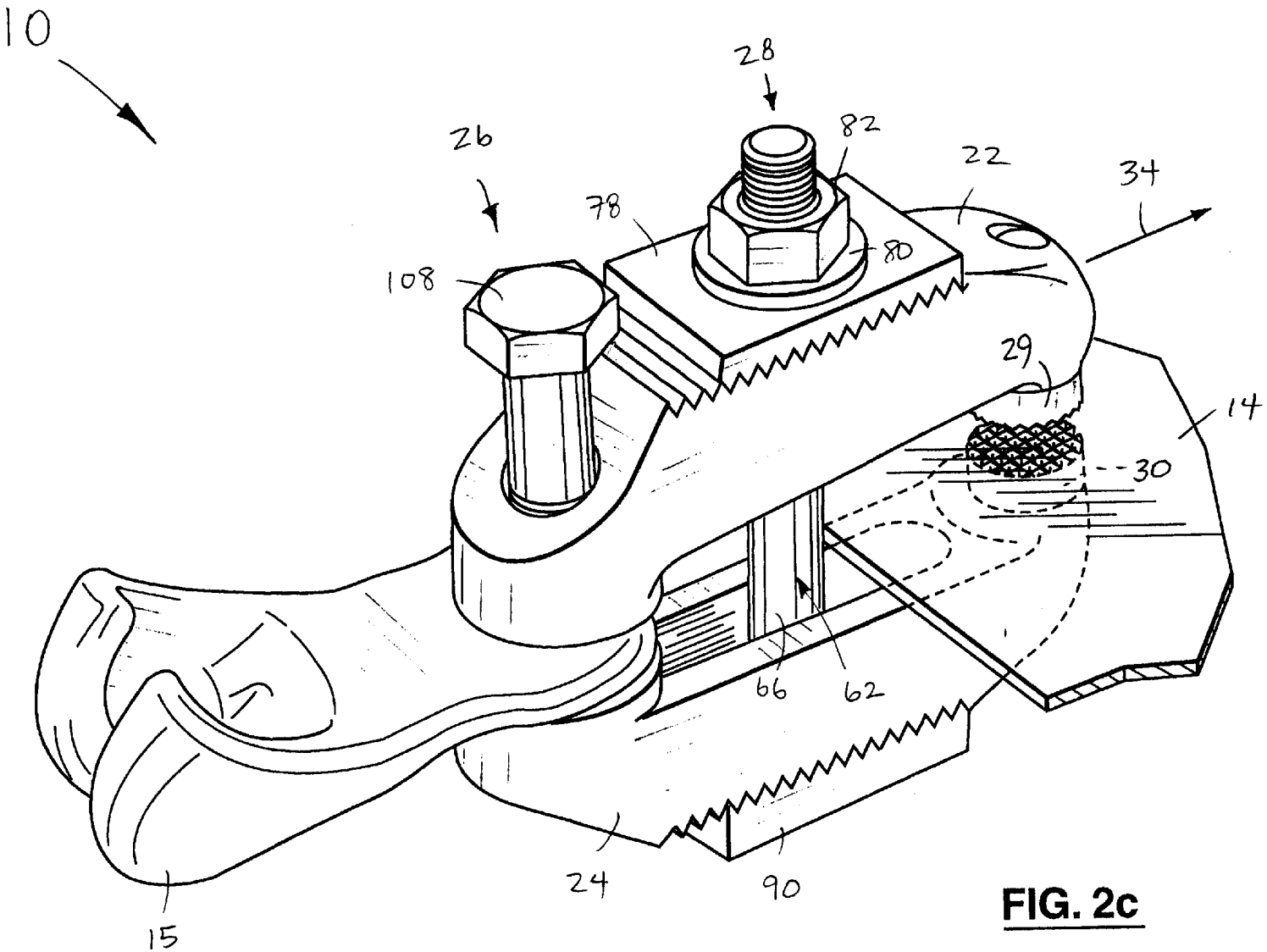
Figure 2D:
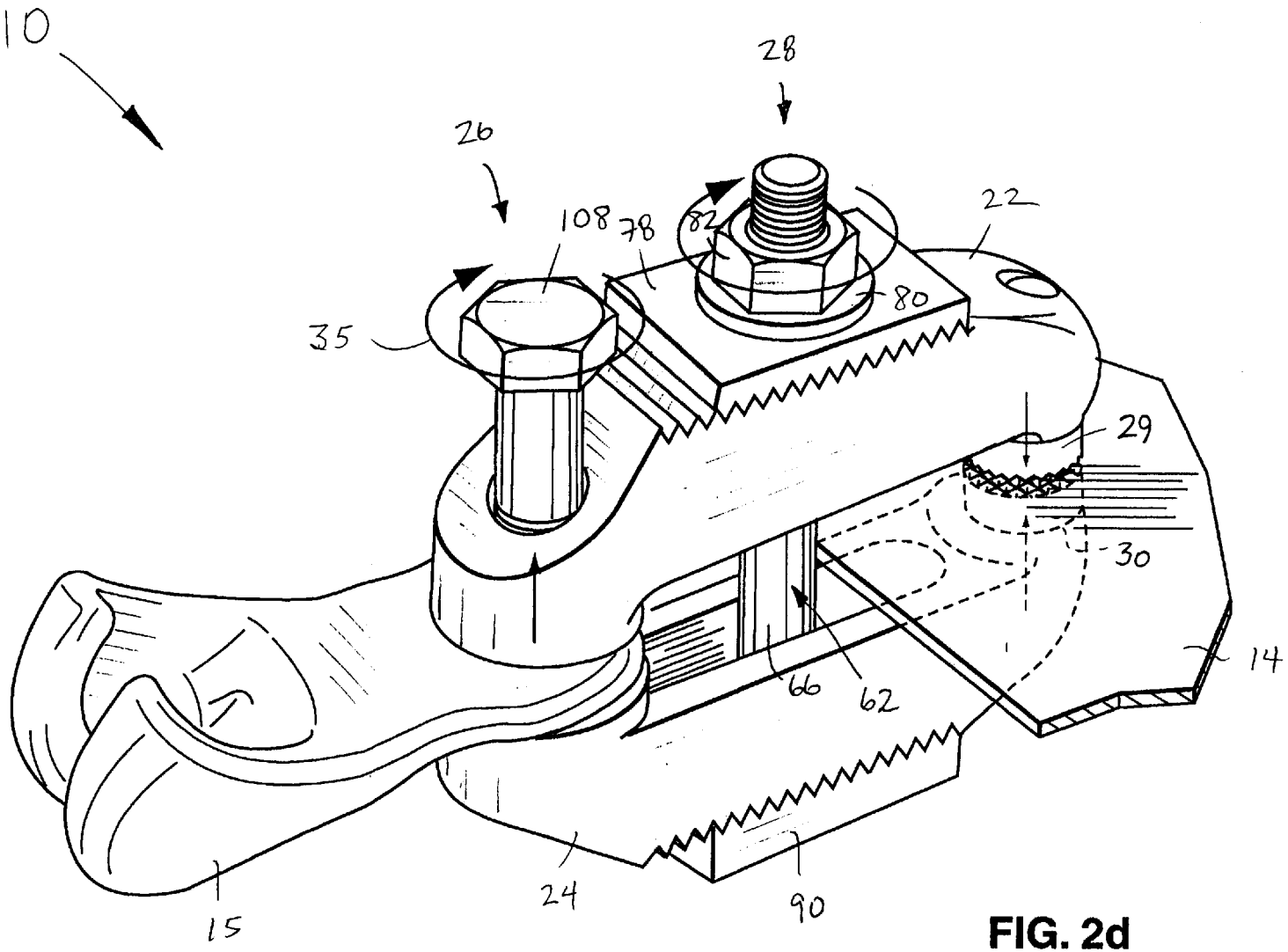
Figure 2E:
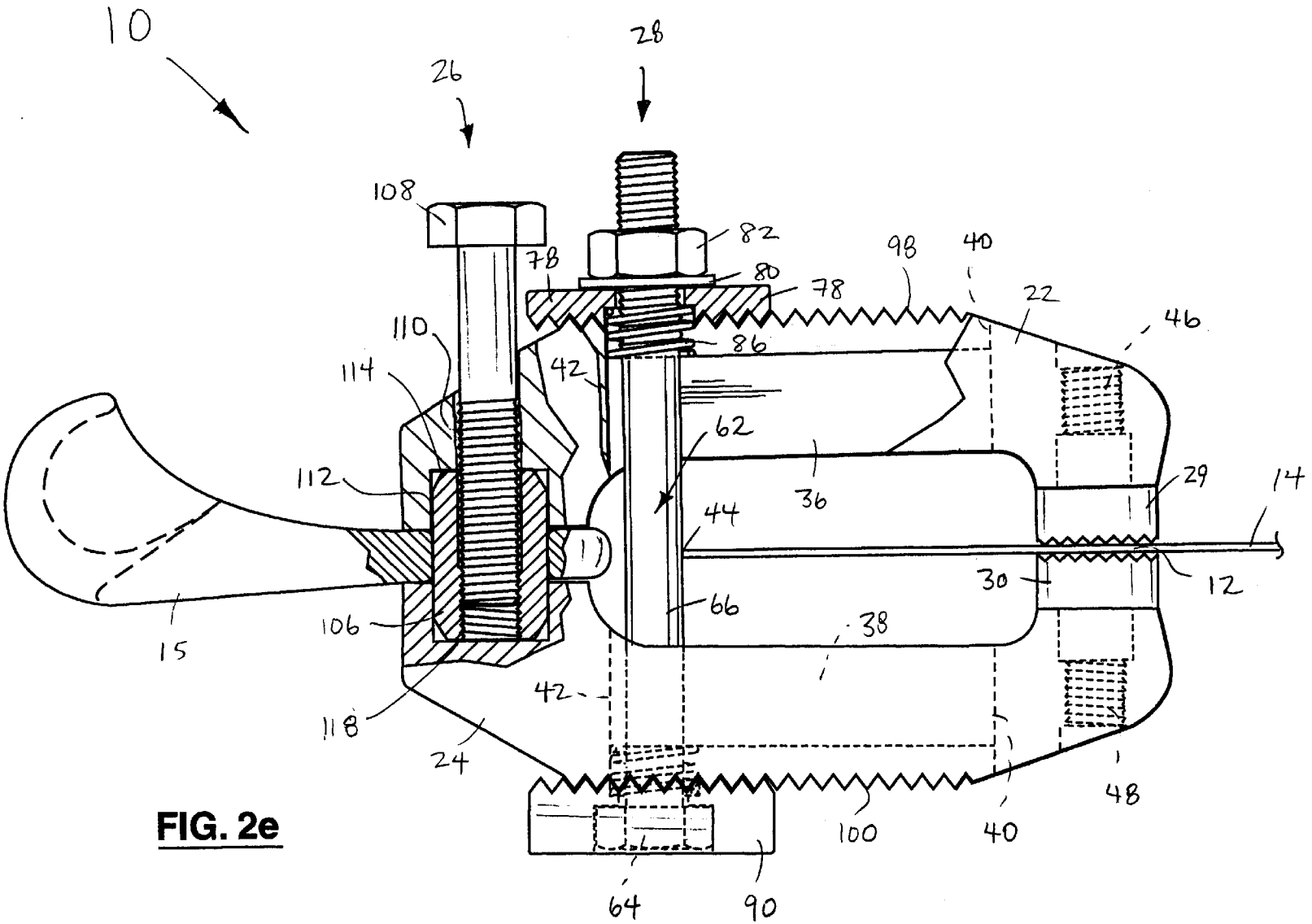
FIG. 2*e* is a perspective view of the clamp of FIG. 1 showing an adjustable pivot assembly of the locking mechanism being positioned in an alternate selected position proximate a tightening bolt of the mechanism so that the clamp may grip an alternate anchor point on the structural component.
Figure 3:
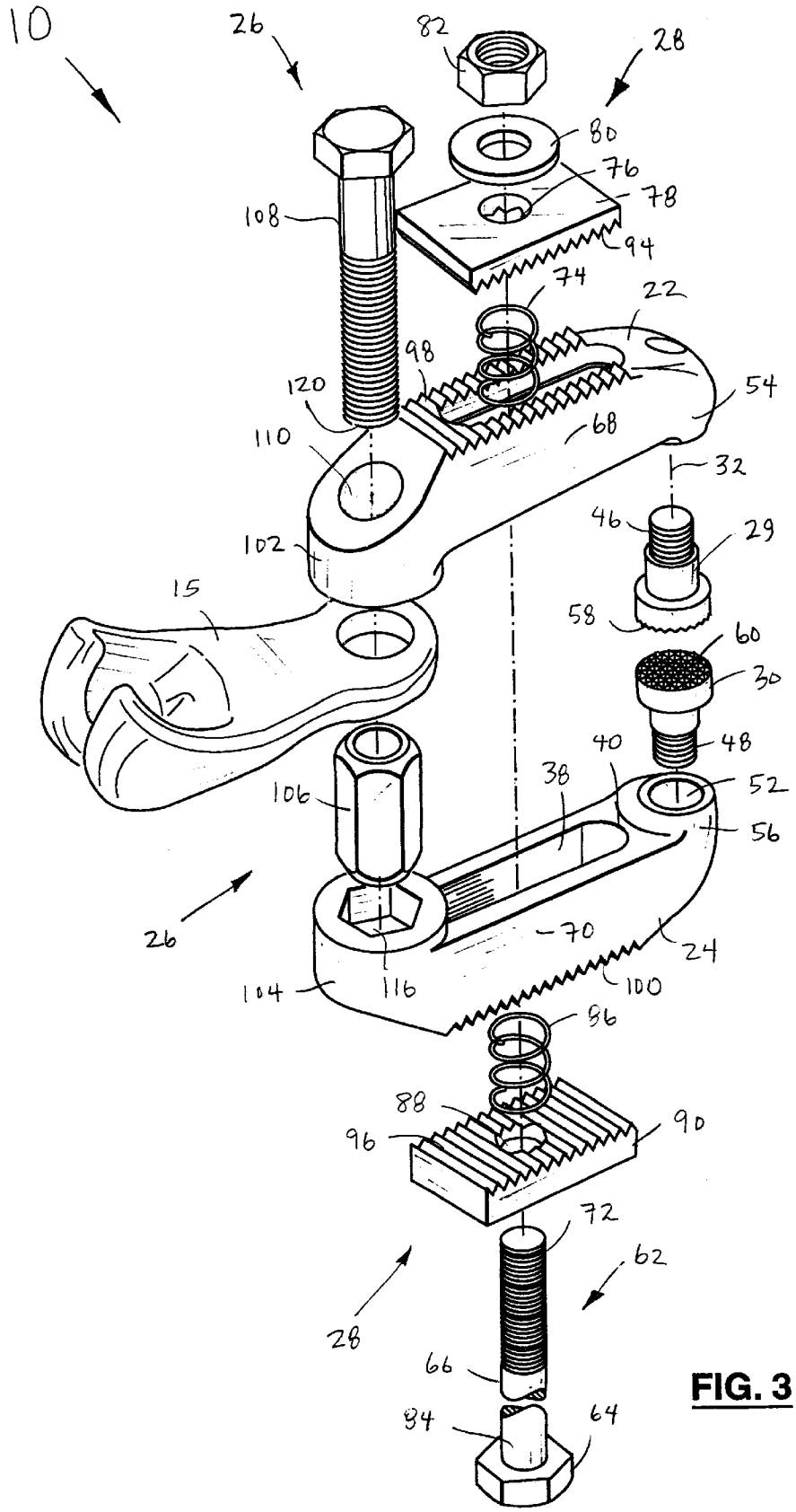
FIG. 3 is an exploded perspective view of the clamp of FIG. 1 showing all of the components thereof.

An automobile repair clamp, designated generally by reference 10, is shown in FIGS. 1 to 3. In FIG. 1, the clamp 10 is shown in a clamping position on an imaginary anchor point 12 on an imaginary damaged automobile structural component 14, shown partially and in chain-dotted outline for illustration purposes. The clamp 10 is adapted to be coupled to a pulling device (not shown) using a rotating connector 15 to which a first end of a metal pull chain 17 is attached. An opposite end (not shown) of the pull chain 17 is attached to the pulling device for pulling the anchor point 12 in a first plane indicated by arrow 16 to straighten the structural component 14, as will be described in more detail below. As shown in this figure, the anchor point 12 is being pulled in a first direction shown by arrow 18 within the plane 16. However, the clamp 10 may be oriented in one of a selected number of angular positions within the plane 16 and pulled in different directions such as a second direction shown by arrow 20 in chain-dotted outline. The clamp 10 includes a pair of U-shaped clamping jaws 22,24 which are moveable together into the clamping position shown and apart to respectively grip and release the anchor point 12. The clamp 10 further includes a locking mechanism consisting of a biassing assembly designated generally by reference 26 and an adjustable pivot assembly designated generally by reference 28. The locking mechanism is coupled to the clamping jaws 22,24 for selectively locking the jaws 22,24 in the clamping position shown. Each of the clamping jaws 22,24 includes an adjustable, removable, and rotatable gripper 29,30 of a shape and size selected to achieve a proper grip on the anchor point 12. Because the grippers 29,30 are rotatable about an axis 32, the angular position of the clamp 10 on the structural component 14 may be adjusted within plane 16 so as to be aligned with the direction of pull by the pulling device. This serves to minimize secondary damage to the structural component 14 during the repair process. The repair clamp 10 will now be described in more detail with reference to FIGS. 2 to 3 below.

Operation of the clamp 10 is illustrated by FIGS. 2*b* to *e*. FIGS. 2*b* and *c* show the clamp 10 with the jaws 22,24 slightly apart being advanced in the direction of arrow 34 into a position with the grippers 29,30 on either side of an anchor point. FIG. 2*d* shows the locking mechanism being operated, by rotating a tightening bolt 108 thereof in the direction of arrow 35, to lock the clamping jaws 22,24 into a clamping position on the anchor point, as will be further discussed. Referring to FIG. 2*e*, it can be seen that the adjustable pivot assembly 28 is movable within elongated slots 36,38 in clamping jaws 28,24, respectively, between first and second ends 40,42 of the slots 36,38. In FIG. 2*e*, the pivot assembly is displaced towards the second ends 42 proximate the biassing assembly 26. This permits the clamp to be engaged over an anchor point located at a greater distance from an end edge of 44 of the vehicle structural component 14, and over obstructions, as will be described further below.

The components of the clamp 10 will be described in further detail with reference to FIGS. 2*a* and 3. FIG. 2*a* shows one embodiment of grippers 29,30. These grippers 29,30 are similarly shaped and sized and are of a stepped cylindrical configuration as shown. Each gripper 29,30 has an externally threaded cylindrical mounting shank 46,48 for receipt by a complementary internally threaded receiver 50,52 in first end portions, or arms, 54,56 of the U-shaped clamping jaws 22,24. The threaded nature of the shanks 46,48 and receivers 50,52 permit rough, indented gripping surfaces 58,60 of the grippers 29,30 to be positioned at varying distances relative to the corresponding clamping jaws 22,24 (i.e. be height adjustable). This height adjustability feature facilitates use of the clamp on vehicle structural components or anchor points of varying thicknesses.

The adjustable pivot assembly 28 includes a pivot member in the form of a bolt 62 including a bolt head 64 and shaft 66. The bolt 62 is secured to bridges 68,70 of U-shaped clamping jaws 22,24 within slots 36,38 as follows. An end portion 72 of bolt shaft 66 is externally threaded and extends through slot, 36 a spring coil 74, an aperture 76 in a serrated rectangular pivot locator 78, a circular washer 80 and a hexagonal, internally threaded retaining nut 82, in series. An opposite end portion 84 of bolt shaft 66 extends through slot 38, a second spring coil 86 and partway through an aperture 88 in a second serrated rectangular pivot locator 90 having a recessed outer surface 92 shaped to receive the bolt head 64 therein. These pivot locators 78, 90 function to keep the bolt 62 in a selected position within the slots 36,38 and have inner grooved or serrated surfaces 94,96 which are complementary to the grooved or serrated outer surfaces 98,100 of the bridges 68,70, respectively, for mating engagement therewith. Thus, the pivot locators 78,90 are securable to the bridges 68,70 in one of a number of selected positions with the grooved surfaces 94,96,98,100 being in mating engagement when the retaining nut 82 is advanced along the end portion 72 of the bolt shaft 66. When in such mating engagement, the pivot bolt 62 is secured in a selected position within the slots 36,38. Further tightening of the nut 82 serves to effect a pre-tightening of the clamp 10 by bringing the clamping jaws 22,24 closer together. This pre-tightening step is performed after the grippers 29,30 are positioned in place over the desired anchor point in order to maintain the clamp in the desired position on the structural component. The spring coils 74,86 function to bias the clamping jaws 22,24, and hence grippers 29,30 apart when the retaining nut 82 is loosened. This facilitates use of the clamp since there is no need to manually maintain the grippers apart when positioning them over the desired anchor point.

The next step is to further tighten the clamp 10 to achieve the desired grip on the anchor point. This is accomplished by operating the biassing assembly 26 which will now be discussed.

Second end portions or arms 102,104 of the clamping jaws 22,24 have cam receivers to receive a cam in the form of a hexagonal cam nut 106 and a cam displacement member in the form of a tightening bolt 108 therein. Specifically, the arm 102 of clamping jaw 22 includes a throughbore with a first cylindrical portion 110 dimensioned for sliding receipt of the partially threaded shaft of tightening bolt 108 therethrough. A second portion 112 of the throughbore is also cylindrical and has a greater diameter to accommodate a top portion of the hexagonal cam nut 106 therein. A generally annular cam-bearing surface 114 is formed at the junction of the first and second portions 110,112 of the throughbore. The arm 104 of clamping jaw 24 has a hexagonal recess 116 formed therein to accommodate a bottom portion of the hexagonal cam nut at 106 in a non-rotating complementary fit. An end wall 118 of the hexagonal recess 116 functions as a second bearing surface for the tightening bolt 108. The hexagonal cam nut 106 is centrally bored, the bore having internal screw threads for complementary receipt of the external screw threads of the tightening bolt 108. Rotating the tightening bolt 108 causes the shaft thereof to advance through the hexagonal cam nut 106. As the bolt 108 is tightened further, an end 120 of the bolt shaft thereof bears against the end wall 118 and causes the hexagonal cam nut 106 to advance further along the shaft towards the bolt head of the tightening bolt and against the cam bearing surface 114. This serves to pry or bias the arms 102,104 apart to exert a force about the pivot bolt 62 and to bring the arms 54,56 containing the grippers 29,30 together into the clamping position. The above-described locking mechanism permits the grippers 29,30 to be leveraged together about a pivot point set by the location of the pivot bolt 62.

The hexagonal cam nut 106 functions not only as a cam member to bias the second arms 102,104 apart, but also as a protective sheath around the tightening bolt 108. As can be seen best with reference to FIG. 3, the rotating connector 15 has a first connecting aperture 122 sized to receive an intermediate portion of the hexagonal cam nut 106 therethrough in a rotating fit. If the hexagonal cam nut 106 were not present, the connector 15 would directly engage the tightening bolt 108 and, during pulling, the bolt 108 may be damaged.

Figure 4:
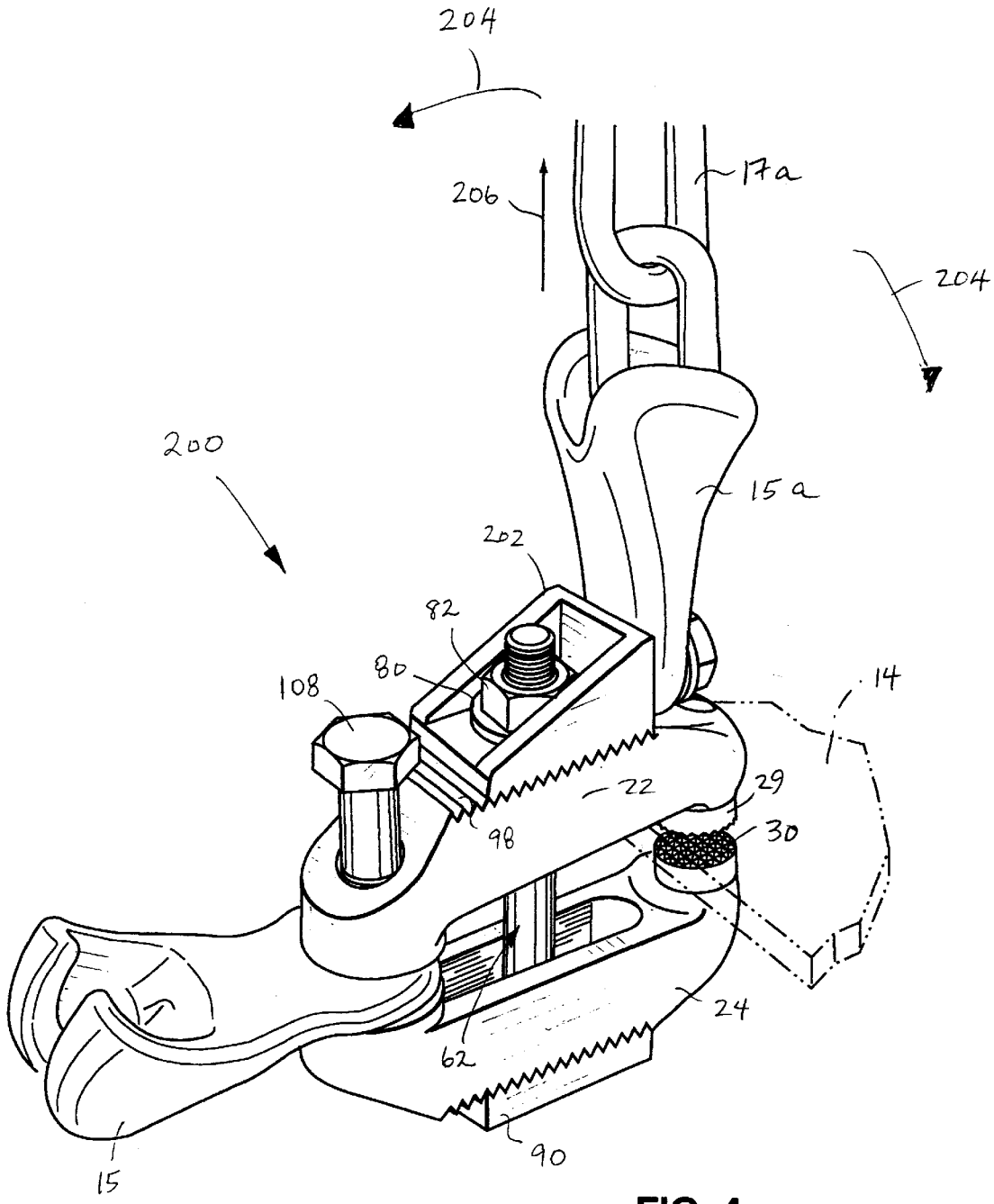
FIG. 4 is a perspective view of an automobile repair clamp according to a second preferred embodiment of the invention having an angle bracket assembly permitting the anchor point to be pulled in a second plane generally perpendicular to the first plane shown in FIG. 1.

Referring now to FIG. 4, a clamp designated generally by reference 200 is shown. The clamp 200 is similar to the clamp 10 in all respects, except as follows, and like reference numerals have been used to designated like parts. The difference between this embodiment of the clamp 200 and the first embodiment of the clamp 10 described above, is that the clamp 200 includes a first pivot locator in the form of a unitary angled side pull bracket 202 which, like the rectangular pivot locator 78 of the first preferred embodiment, is apertured to receive an end portion 72 of pivot bolt 62 therethrough and includes an inner grooved surface 94 (FIG. 5) which mates with the grooved outer surface 98 of the clamping jaw 22. Also like the rectangular pivot locator 78, the angled side pull bracket 202 is securable to the bridge 68 in one of a number of selected positions using retaining nut 82 and circular washer 80. However, the angled side pull bracket 202 permits attachment of a second connector 15*a* which can be coupled to a pulling device using a chain 17*a* for pulling in a second plane (shown by arrow 204) generally perpendicular to the first plane 16.

Figure 5:
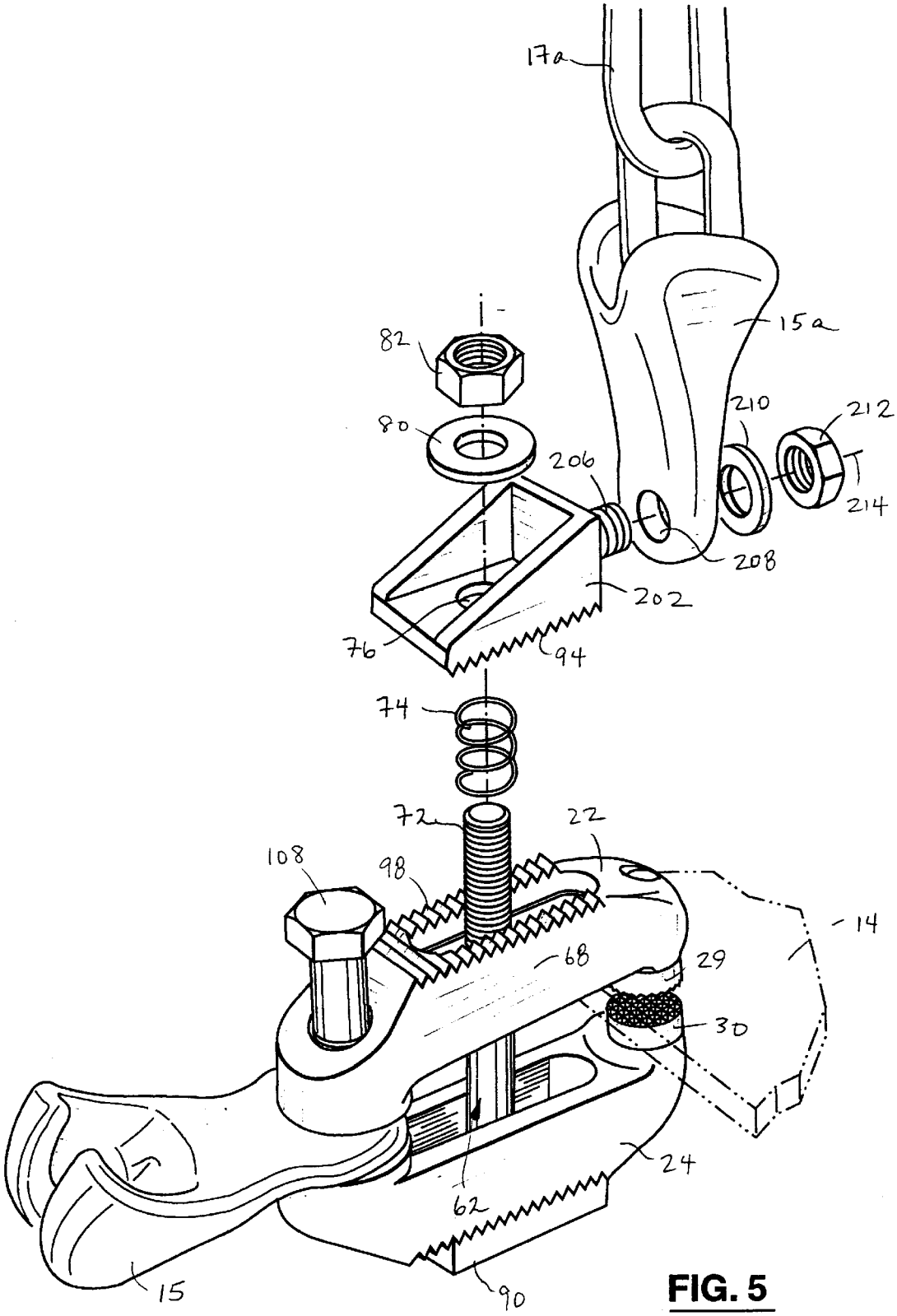
FIG. 5 is a perspective view of the clamp of FIG. 4 showing the angle bracket assembly in an exploded condition to illustrate the components thereof.

Referring to FIG. 5, the second connector hook 15*a* is rotatably retained on a pivot arm 206 of the angled side pull bracket 202 using a circular washer 210 and a retaining nut 212. Thus, the second connector hook 15*a* is pivotable in the second plane 204 about an axis 214 to permit pulling in different directions within the second plane (see FIG. 5). See for example, arrow 206 (FIG. 4) which indicates one of the directions of pull within the second plane 204.

Figure 6D:
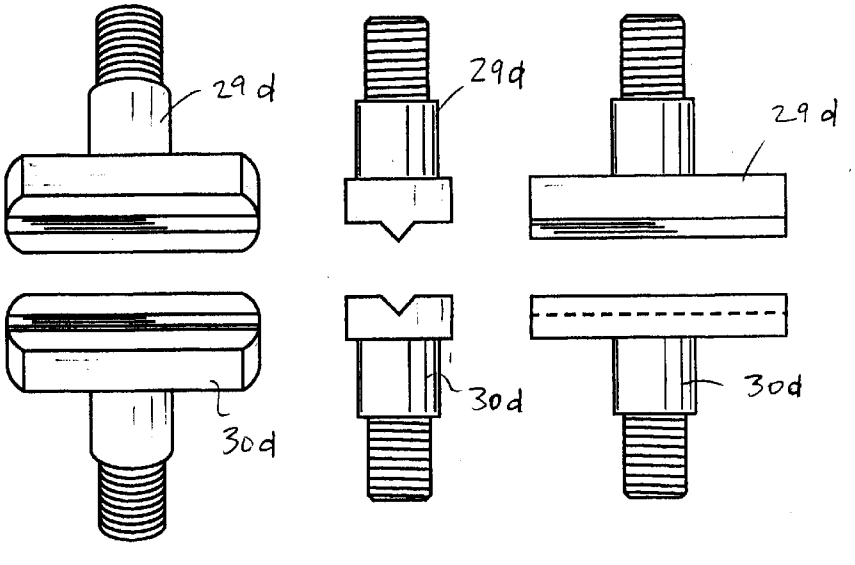
FIGS. 6*a* to *h* are perspective and side views of several preferred embodiments of interchangeable grippers which may be used in clamps according to the invention.
Figure 6C:
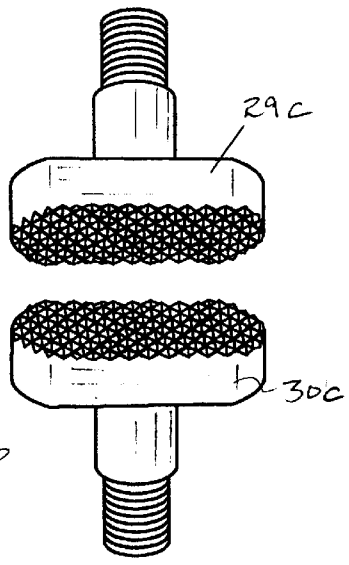
Figure 6B:
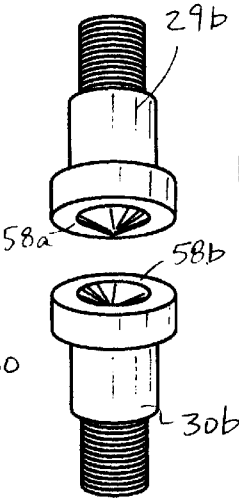
Figure 6A:
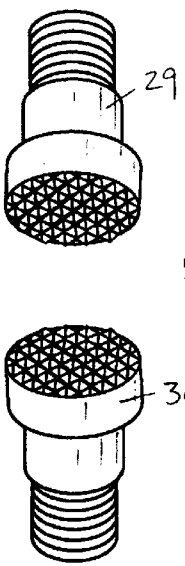

The grippers 29,30 come in a variety of shapes and sizes to suit the particular task. Exemplary embodiments are shown in FIGS. 6*a* to *h*. FIG. 6*a* shows the grippers 29,30 of the clamp 10 and 200 shown in FIGS. 1 to 5. The grippers 29, 30 have round serrated gripping surfaces and are suitable in applications involving lower pulling forces. Depending on the configuration of the anchor point and its immediate surrounding environment, rectangular grippers such as those shown in FIG. 6*c* may be preferred. These grippers 29*c*, 30*c* are preferred in situations where the anchor point is adjacent to a straight upstanding lip or the like. A straight side edge of the grippers 29*c*, 30*c* may be placed flush against the lip for a more secure grip. As in the case of grippers 29, 30, these grippers 29*c*, 30*c* have serrated gripping surfaces for better grip.

Where higher pulling forces are used and where deformation of the anchor point can be tolerated, the male-female grippers shown in FIGS. 6*b*, and 6 *d–h*, are preferred. These grippers 29*b* and *d–h*, 30*b* and *d–h*, have complementary protrusions and receivers which deform the anchor point when the clamp is engaged to provide enhanced grip. As can be seen in the drawings, grippers 29*b*, 30*b* of FIG. 6*b* have smooth circular gripping surfaces with a conical protrusion and a conical receiver, respectively. FIG. 6*d* shows grippers 29*d*, 30*d* having smooth, generally rectangular gripping surfaces having a linear angular protrusion and linear angular receiver, respectively. The grippers 29*d*, 30*d* would also be useful in gripping anchor points adjacent to a straight-edged obstruction or lip.

Figures 6E, 6F, 6G, 6H:
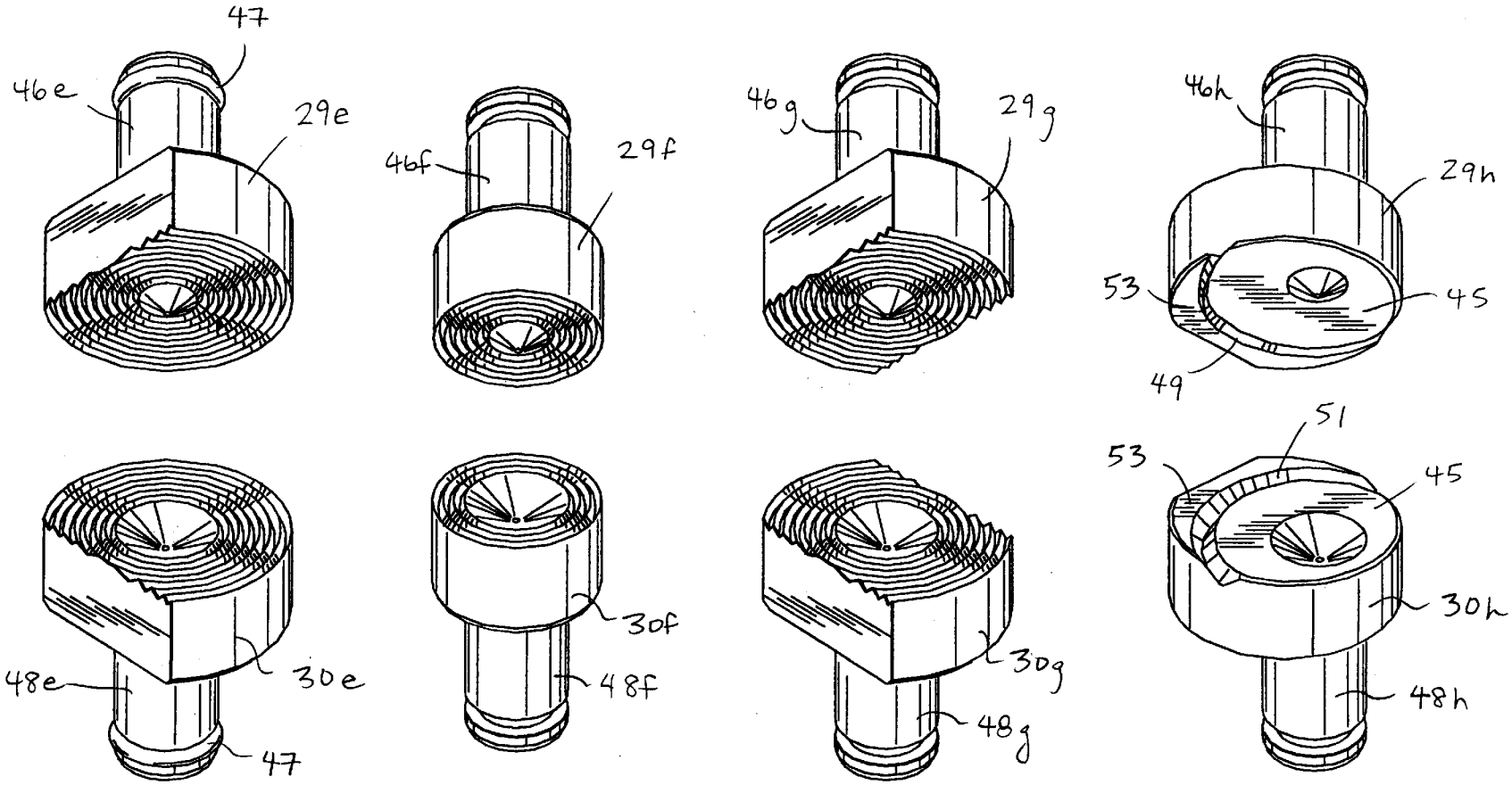

FIGS. 6*e* to *h* illustrate embodiments of grippers having unthreaded cylindrical mounting shanks 46*e–h*, 48*e–h* which are journalled to receive a suitably sized rubber O-ring. Only FIG. 6*e* shows O-rings 47 mounted on the shanks 46*e*, 48*e*. However, it will be appreciated that the other grippers 46*f–h* and 48*f–h* will have similar O-rings mounted on the shanks thereof to frictionally retain the shanks in the receivers 50, 52 of the clamping jaws of the clamp. It will be further appreciated that these grippers 46*e–h*, 48*e–h*, being unthreaded, are not height adjustable within the receivers 50, 52 and that, therefore, they are suitable for use in situations where such feature is not required.

Grippers 29*e–g*, 30*e–g* all have a series of concentric, alternating ridges and grooves and respective conical protrusions and receivers, respectively, for enhancing the grip. Grippers 29*e*, 30*e* have generally circular gripping surfaces with a flat side edge for abutting straight-edged obstructions on the structural component. Grippers 29*f*, 30*f* have circular gripping surfaces for general applications. Grippers 29*g*, 30*g*, have two opposite parallel side edges, either which may be used to abut straight-edged obstructions.

The grippers 29*h*, 30*h* shown in FIG. 6*h* have smooth gripping surfaces having a circular portion 45 with a conical protrusion and receiver, respectively, centred therein. The grippers 29*h*, 30*h* further have an arcuate protrusion and a mating arcuate receiver 49, 51, respectively, disposed at a circumference of the circular portions 45 for also deforming the anchor point to further enhance the grip. Arcuate extensions 53 of the grippers 29*h*, 30*h* provide the grippers with a larger gripping area in circumstances where that is desired. Due to the centred nature of these grippers 29*h*, 30*h*, rotation thereof permits the clamp to engage different areas on the structural component, as may be desired.

The grippers shown in FIGS. 6*b* and 6*e–h* have conical protrusions and receivers centred along the axis of rotation of the grippers thereby permitting mating engagement at varying angular positions of the grippers relative to the clamping jaws.

Figure 7:
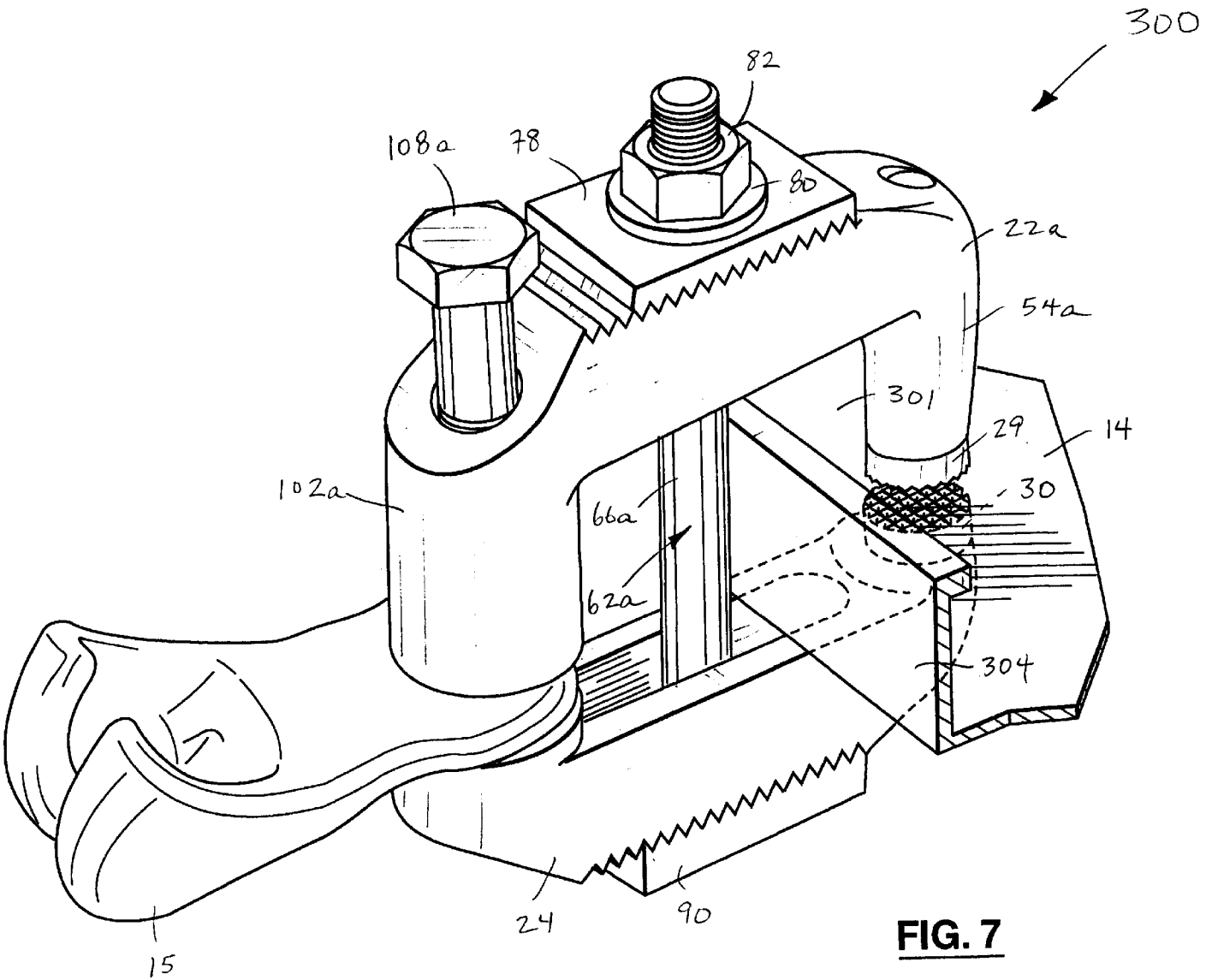
FIG. 7 is a perspective view of an automobile repair clamp according to a third preferred embodiment of the invention having one deep clamping jaw, the clamp being shown engaging an anchor point over an obstruction.

Clamps according to the present invention are modular in design, including interchangeable components, thereby allowing for numerous configurations to be achieved with minimal parts. This is illustrated further in FIGS. 7 and 8 which show alternative embodiments of components of the clamps 100,200. FIG. 7 shows a clamp 300 having components similar to that of the clamp 100 and, again, like reference numerals have been used to denote like parts. The clamps 100 and 300 differ in relation to the top clamping jaw and pivot bolt components. Clamp 300 has a clamping jaw 22*a* which has longer arms 54*a* and 102*a* than the arms of the clamping jaw 22. This provides a deeper throat 301 to permit the clamp 300 to be fitted over obstructions such as an upturned lip 304 of the structural component 14 shown. In this embodiment, clamp 300 has a pivot bolt 62*a* with a shaft 66*a* longer than the shaft 66 of the first and second preferred embodiments to span the deeper throat 301. In all other respects, the clamp 300 is similar to the clamp 10.

Figure 8:
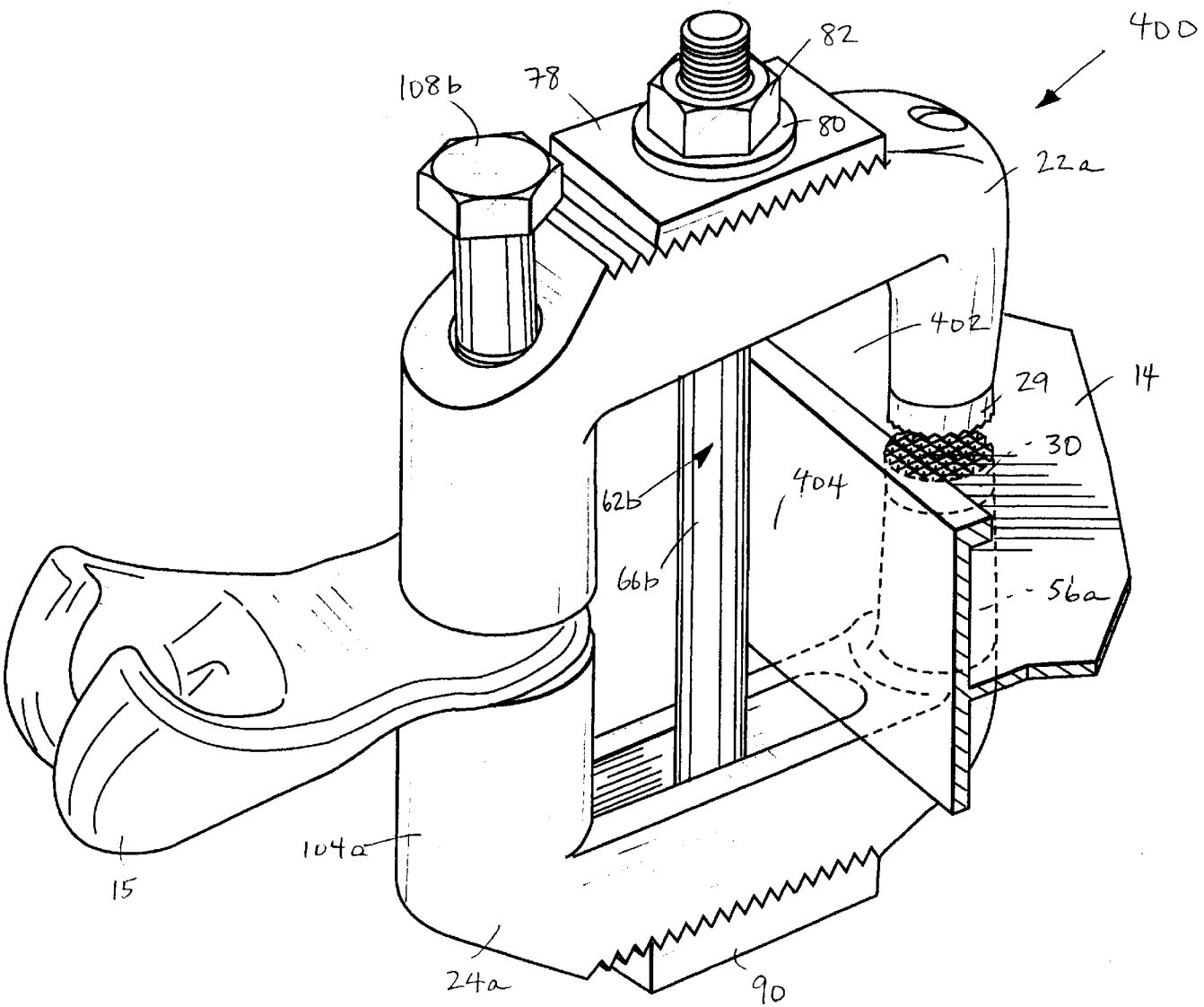
FIG. 8 is a perspective view of an automobile repair clamp according to a fourth preferred embodiment of the invention having two deep clamping jaws, the clamp being shown in engagement on an anchor point over an obstruction larger than the obstruction of FIG. 7.

The shape and dimensions of the lower clamping jaw may also be different as illustrated in FIG. 8 which shows a clamp 400 in which a second or lower clamping jaw 24*a* has longer arms 56*a* and 104*a* to provide an even deeper throat 402 so that the clamp 400 can be fitted over even larger obstructions such as end flange 404. As in the case of the clamp 300, the clamp 400 has a longer pivot bolt 62*b* capable of spanning an even deeper throat 404. The clamp 400 is similar in all other respects to the clamp 300 and like reference numerals have been used to designate like parts.

Figure 9:
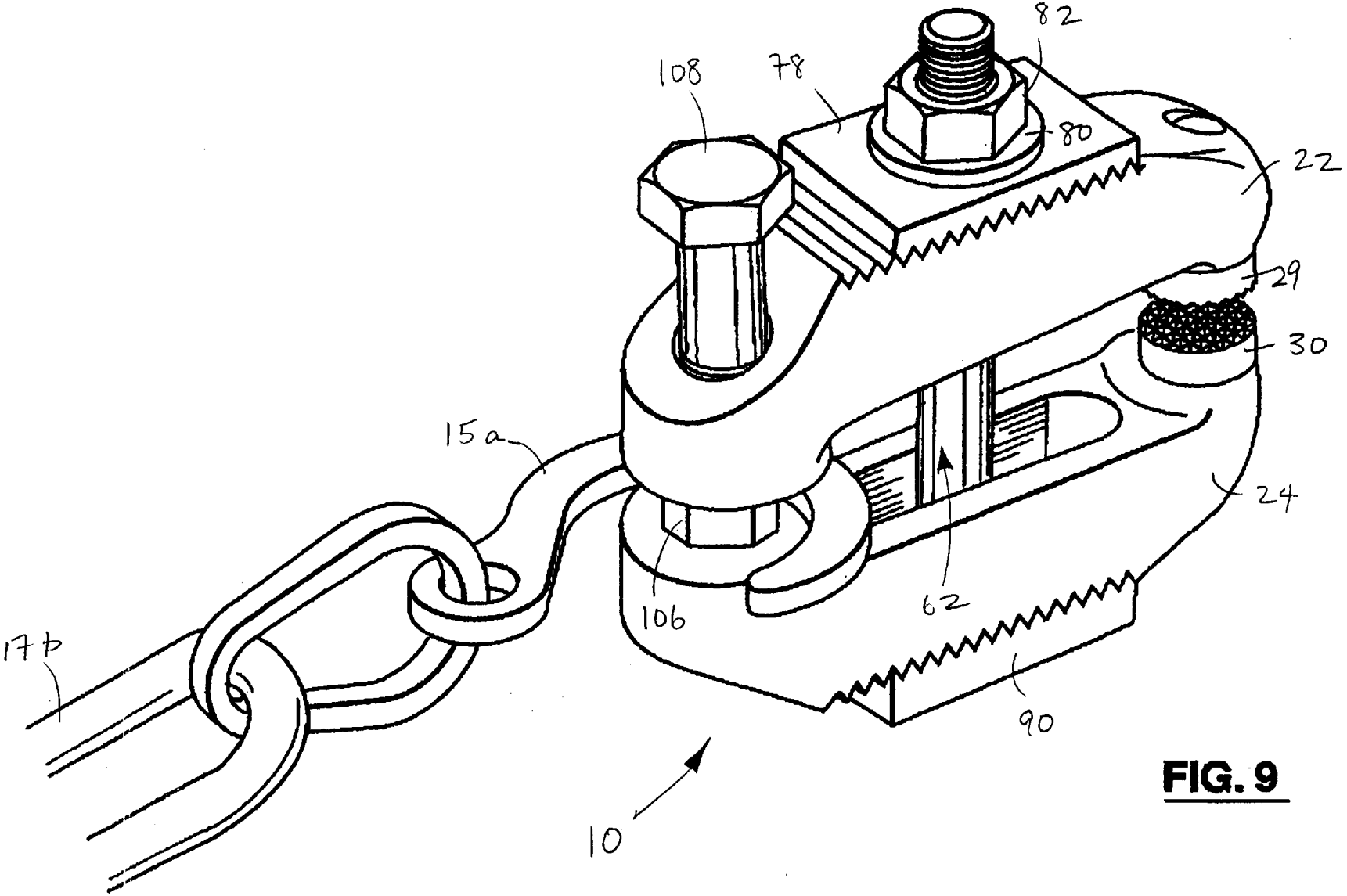
FIG. 9 is a perspective view of the clamp of FIG. 1 illustrating an alternative connector hook which may be used to connect the clamp to a pull chain having a remote end connected to a pulling device.

Different embodiments of connectors may be used to connect clamps according to the present invention to a pulling device. For example, an open hooked connector 15*a* shown in FIG. 9 may be used. The connector 15*a* permits faster and easier assembly of the repair system. First, the clamp 10 is mounted on the anchor point at the desired angle and then the connector 15 which is linked to the pulling device using a metal chain 17*b* is hooked around the hexagonal cam nut 106. Although not shown in the drawings, the connector may also be in the form of a simple ring.

Figure 10:
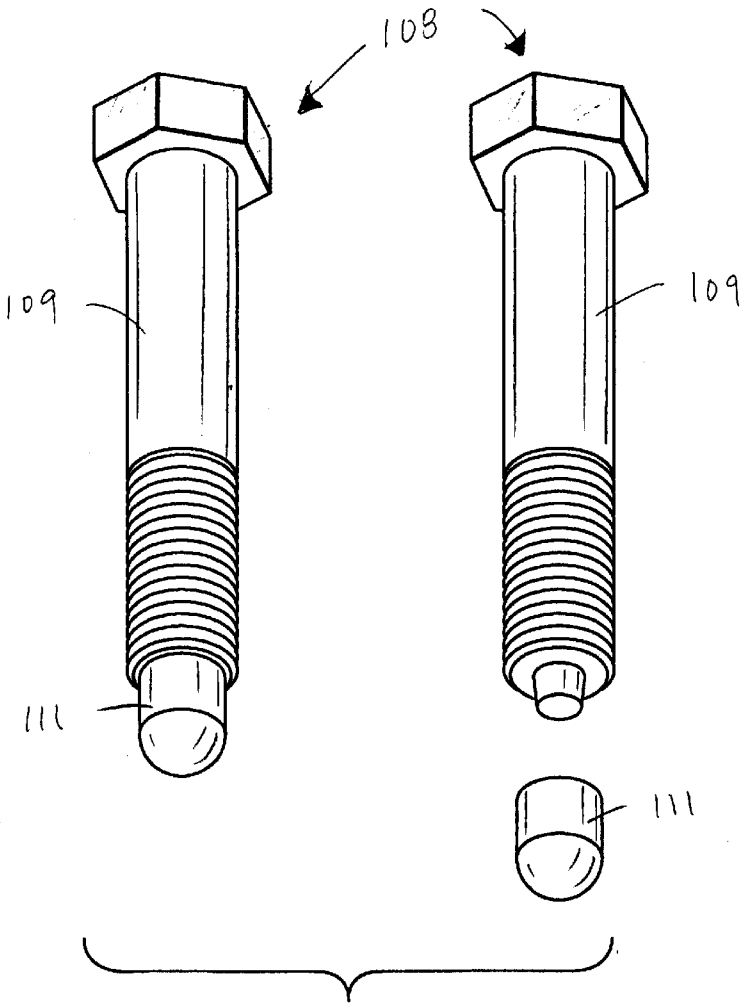
FIG. 10 is a perspective view of an alternative tightening bolt of a locking mechanism of the various embodiments of the clamp, the bolt having a two part structure, including a protective end cap.

FIG. 10 illustrates a variation on the tightening bolt 108 of the above embodiments of the clamp. The tightening bolt 108*a* is in two parts. A first part is a partially threaded main body portion 109 having a journalled tip. A second part is a protective end cap 111 for covering the journalled tip and protecting it against wear when the bolt 108*a* is received by the hexagonal cam nut 106 and bearing against the end wall 118 of the clamp.

Figure 11:
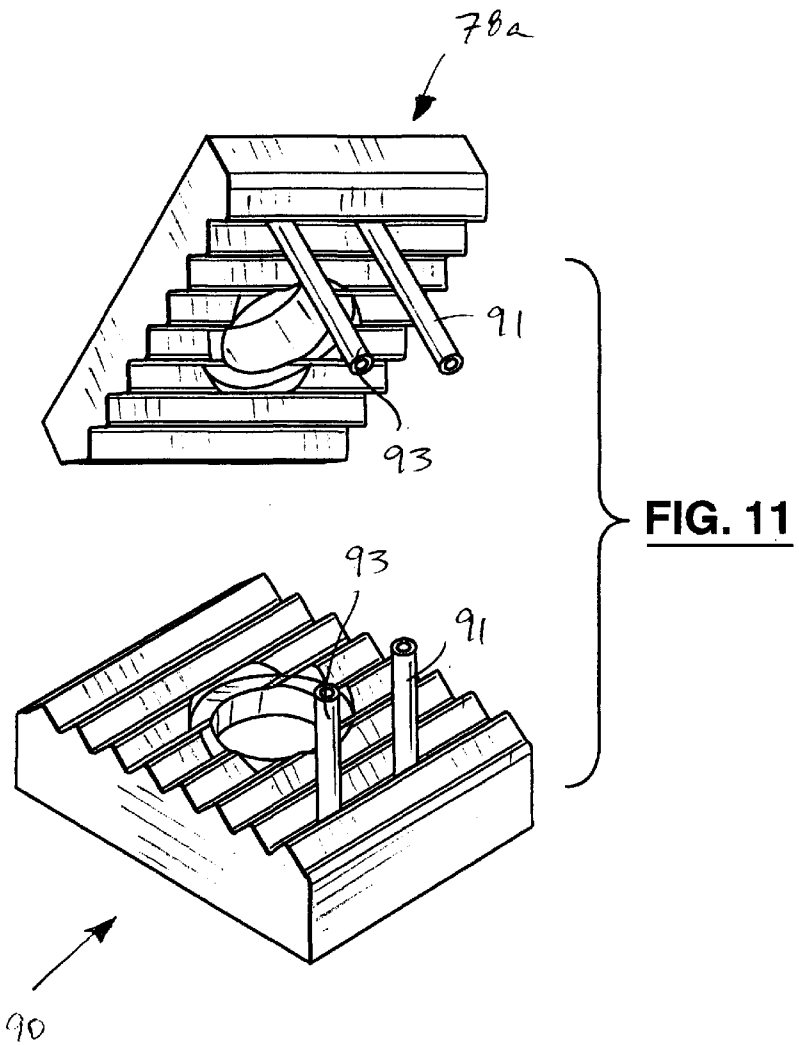
FIG. 11 is a perspective view of alternative embodiments of pivot locators of a pivot assembly of various embodiments of the clamp.

FIG. 11 shows variations to the rectangular pivot locators 78, 90 of the above embodiments. The pivot locators 78*a*, 90*a*, are similar in all respects to the embodiment described above except that they each has alignment members in the form of a pair of spaced parallel locating pins 91, 93 extending perpendicularly from a serrated surface thereof. The locating pins 91, 93 extend through the slots 36, 38 in the clamping jaws and prevent the locators 78*a*, 90*a* from rotating and becoming misaligned with the groove outer surfaces 98, 100 of the clamping jaws when the retaining nut 82 is loosened in the process of spreading the jaws apart.

It will be appreciated that the foregoing description is by way of example only and that many variations to the embodiments thus described are contemplated without departing from the scope of the invention as defined by the following claims.

We claim:

1. An automobile repair clamp for clamping onto an anchor point on a damaged automobile structural component, the clamp being adapted to be coupled to a pulling device for pulling the anchor point in a first plane to straighten the structural component, and comprising a pair of clamping jaws movable together into a clamping position and apart to respectively grip and release said anchor point, each clamping jaw including a rotatable gripper for gripping the vehicle body and permitting adjustment of the angle of the clamping jaws relative to the automobile structural component to allow the clamp to be aligned with the direction of pull by the pulling device, and having opposite first and second end portions connected by a bridge, said grippers being disposed in said first end portions; and a locking mechanism coupled to the clamping jaws for selectively locking the jaws in said clamping position, said locking mechanism comprising an adjustable pivot assembly including a pivot member secured to said bridges in one of a selected number of positions, and a biasing assembly disposed in said second end portions for biasing said second end portions apart to exert a force about the pivot member and to leverage said first end portions and grippers together into said clamping position.

2. A clamp according to claim 1 wherein each bridge has an elongated slot with first and second ends proximate said first and second end portions respectively, said pivot member being slidably retained in said slots between said first and second ends in one of said selected number of positions.

3. A clamp according to claim 2 wherein said bridges have outer surfaces, said adjustable pivot assembly comprising a pair of pivot locators having inner surfaces dimensioned to be complementary to said outer surfaces and securable one to each bridge in one of a number of selected positions relative to the corresponding bridge and with the respective surfaces being in mating engagement, said pivot locators being apertured to receive a corresponding end portion of said pivot member therethrough; and retainers for retaining said pivot locators on said pivot member;

whereby said pivot Member is located in a selected position within said slots by said pivot locators.

4. A clamp according to claim 3 wherein said pivot locators have alignment members for receipt by said slots to keep said pivot locators in alignment with said clamping jaws.

5. A clamp according to claim 3 wherein one of said locators functions as a bracket for connecting the clamp to a pulling device for pulling the clamp in a second plane generally perpendicular to the first plane.

6. A clamp according to claim 1 wherein said second end portions have cam receivers, one of said cam receivers including a cam bearing surface, the other of said cam receivers including a second bearing surface, and wherein said biassing assembly comprises a cam seated in said cam receivers, and a cam displacement member operably connected to said cam for biassing said cam against said cam bearing surface and away from said second bearing surface to thereby bias said second end portions apart.

7. A clamp according to claim 1 further comprising a bracket removably attached to one of said clamping jaws for connecting the clamp to a pulling device for pulling the clamp in a second plane generally perpendicular to the first plane.

8. A clamp according to claim 1 wherein each clamping jaw has a U-shaped body, the first and second end portions of each clamping jaw being first and second arms, respectively, of the U-shaped body, and each clamping jaw is removable and of a size and shape selected to allow the clamp to be used over obstructions.

* * * * *